United States Patent [19]

White et al.

[11] 4,168,226

[45] Sep. 18, 1979

[54] THERMAL STABILIZATION OF N-METHYL-2-PYRROLIDONE

[75] Inventors: Anthony M. White, Bright's Grove; Bruce M. Sankey, Sarnia, both of Canada

[73] Assignee: Exxon Research & Engineering Co., Florham Park, N.J.

[21] Appl. No.: 951,863

[22] Filed: Oct. 16, 1978

Related U.S. Application Data

[63] Continuation of Ser. No. 785,745, Apr. 8, 1977, abandoned.

[51] Int. Cl.[2] ..... C10G 21/28

[52] U.S. Cl. ..... 208/321; 208/326

[58] Field of Search ..... 208/321, 326

[56] References Cited

U.S. PATENT DOCUMENTS

| | | | |
|---|---|---|---|
| 2,933,448 | 4/1960 | Morin et al. | 208/326 |
| 3,470,089 | 9/1969 | Morris et al. | 208/326 |
| 3,476,681 | 11/1969 | Davies et al. | 208/326 |
| 3,843,515 | 10/1974 | MacDonald et al. | 208/326 |

*Primary Examiner*—Herbert Levine

*Attorney, Agent, or Firm*—Edward M. Corcoran

[57] ABSTRACT

The thermal decomposition of N-methyl-2-pyrrolidone is minimized by the addition of minor amounts of water thereto prior to its being heated to temperatures in excess of 500° F. This is of particular importance in processes using N-methyl-2-pyrrolidone as an extraction solvent to remove aromatics from mixtures of aromatic and non-aromatic hydrocarbons and wherein the N-methyl-2-pyrrolidone is recovered from the extracted fractions by thermal means such as flash evaporation and distillation.

13 Claims, 1 Drawing Figure

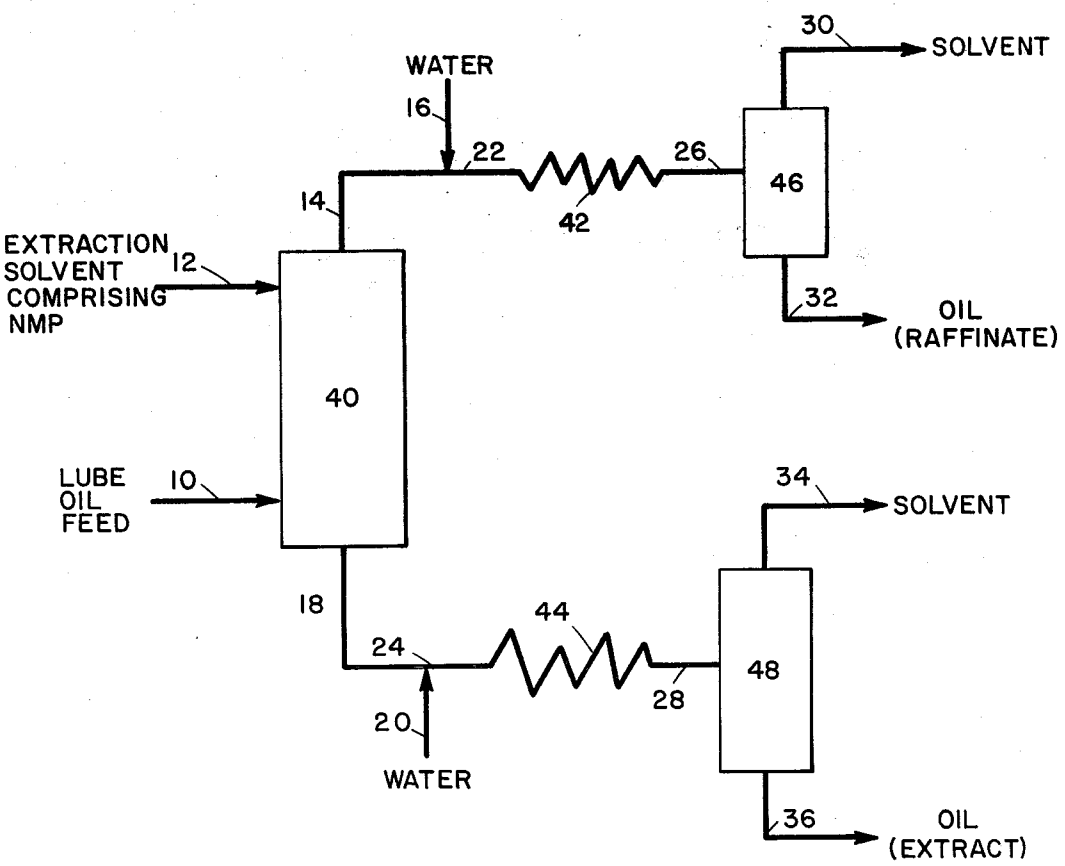
SOLVENT
30
46
OIL (RAFFINATE)
32
26
42
WATER
16
22
14
EXTRACTION SOLVENT COMPRISING NMP
12
40
LUBE OIL FEED
10
18
24
20
WATER
44
28
48
SOLVENT
34
OIL (EXTRACT)
36

THERMAL STABILIZATION OF N-METHYL-2-PYRROLIDONE

This is a continuation of application Ser. No. 785,745, filed 4/8/77 now abandoned.

BACKGROUND OF THE INVENTION

1. Field of the Invention

This invention relates to a method of minimizing the thermal decomposition of N-methyl-2-pyrrolidone, hereinafter referred to as NMP for the sake of brevity. More particularly, this invention relates to a method of minimizing the thermal decomposition of NMP by the addition of minor amounts of water thereto prior to its being heated to high temperatures. Still more particularly, this invention relates to a method of stabilizing the NMP solvent present in lube oil raffinate and extract phases wherein the NMP is separated therefrom via thermal solvent recovery means, said stabilization being accomplished by injecting small amounts of water into said solvent-containing phase prior to introducing same into a preheating furnace for subsequent distillaton or flash evaporation.

2. Description of the Prior Art

NMP has been known as a solvent for the separation of olefins, for the recovery of acetone from petroleum gas, for the extraction of naphthalenic hydrocarbons from various hydrocarbon mixtures, as a chemical reaction medium, polymer solvent, for use in industrial cleaning, for decolorizing petroleum oils and waxes, in paint removers, as a deicer for jet fuels and gasoline, etc. Perhaps the most important and widest industrial use of NMP is as an aromatics extraction solvent in various petroleum refining processes. Illustrative processes are for the separation of benzene, toluene and xylene or the well known BTX process, the recovery and separation of relatively pure, single-ring aromatics such as xylene, benzene and toluene from relatively light hydrocarbon mixtures known in the industry as the Arosolvan process, and in the extraction of aromatics from lube oil fractions in order to produce lube oils of relatively high VI and UV stability. Within the past ten years, a considerable amount of industrial research and development has been expended by the petroleum industry towards the utilization of NMP in lube oil deasphalting, extraction and dewaxing.

Concomitant with increasing interest in the use of NMP for solvent extraction processes, considerable effort has also been directed toward solvent recovery, particularly where NMP is used for solvent refining lube oil fractions and wherein the NMP must be removed from these higher boiling fractions by thermal or extractive means. The most conventional means for removing and recovering extraction solvents from lube oil stocks are flash evaporation and/or distillation, usually followed by steam or inert gas stripping. These recovery methods are the most widely used for extraction solvents such as phenol and have also been suggested for recovering NMP from extracted lube oil fractions.

Solvent extracting lube oil fractions using NMP produces raffinate and extract phases containing NMP. Because lube oil extraction with NMP is normally performed at temperatures below about 300° F., it is necessary to heat the NMP containing phases to higher temperatures in order to separate the solvent therefrom if thermal recovery means are used. Generally, this temperature must be at least 400° F. in order to separate the oil and solvent using either flash evaporation and/or distillation, because NMP boils at about 395° F. or higher, depending on its purity. This minimum thermal separation temperature is readily achieved by heating the solvent containing phases in heat exchangers, such as direct fired tube furnaces, and then passing the hot raffinate and/or extract to flash towers, distillation towers, or combinations thereof, etc. The bulk temperature of the hot, solvent containing oil often exceeds 500° F. and portions thereof may even exceed temperatures in excess of 700° F. Material contained in the thin boundary layer film inside the furnace tubes may be heated to temperatures of 800° F. or more, particularly in the radiant section of the furnace.

It has been found that NMP significantly decomposes when heated to temperature at or above about 700° F. Therefore, it would be a significant improvement to the art if one could find a relatively simple and efficient way of minimizing the thermal decomposition of NMP, particularly when recovering same from extracted lube oil fractions employing thermal recovery means.

SUMMARY OF THE INVENTION

A method has now been found for minimizing the thermal decomposition of NMP heated to temperatures above 500° F., which comprises adding at least about 0.5 LV (liquid volume) % water to same before it is heated to temperatures above 500° F. The essence of this invention is a surprisingly unexpected discovery that the addition of water to NMP greatly inhibits its thermal decomposition. It has also been unexpectedly discovered that even if hydrocarbon fractions are solvent extracted with a solvent comprising NMP and water, such as NMP and 2–3 LV% water, to produce extract and raffinate phases, the NMP present in the raffinate phase is essentially anhydrous. It has been discovered that in processes wherein the NMP is removed from the hydrocarbon raffinate via thermal means and wherein said raffinate is heated to relatively high temperatures exceeding 500° F., adding water to said raffinate before it is heated to the high temperatures, and in an amount so that the water comprises at least about 0.5 LV% of the solvent based on the NMP content thereof, will effectively reduce, minimize or virtually eliminate the thermal decomposition of the NMP. It is to be understood that the exact amount of water be added to the NMP or raffinate containing NMP will depend, of course, upon the conditions of time and temperature of the NMP at the high temperatures above 500° F.

It is extremely difficult to give any finite minimum temperatures above which NMP may not be used without incurring intolerable decomposition. This is because everything depends upon conditions of time, temperature, pressure, water content, type and amount of hydrocarbon and/or other solvent admixed with the NMP and also the nature of surfaces in contact with the solvent. Further, it is believed that the presence of one or more alcohols in the NMP may also aid in reducing the thermal decomposition. The decomposition reaction of NMP approximates the exponential behavior characteristic of free radical branching reactions and may be expressed by the following equation:

$$P=Ae^{kt}$$

where

P is the fraction decomposed

A, k are constants at a given temperature t is the time.

What is important to the invention is the fact that the addition of water to NMP can reduce or minimize the thermal decomposition of the NMP to a point where, for all practical purposes, it becomes either insignificant or tolerable whether the NMP is in fairly pure form or is mixed with other materials such as a lube oil raffinate, wax or the asphaltic extract resulting from NMP deasphalting of resids.

In accordance with this invention, therefore, water in an amount of at least 0.5 LV%, preferably from about 0.5 to 10 LV%, and most preferably from about 1 to 5 LV% of the NMP is added thereto prior to heating the NMP to temperatures in excess of about 500° F. in order to minimize or practically eliminate the thermal decomposition of the NMP. This becomes particularly important when NMP is heated to temperatures above 600° F.

BRIEF DESCRIPTION OF THE DRAWING

The attached drawing is a flow diagram of a preferred embodiment of a lube oil extraction solvent recovery process employing the improvement of the instant invention.

DETAILED DESCRIPTION

Referring to the drawing, a lube oil feed stock is fed via line 10 to extraction zone 40 wherein it is contacted with an extraction solvent comprising NMP which enters the extraction zone via line 12. In general, any petroleum fraction boiling above about 500° F. (at atmospheric pressure) is suitable for use as a feed in the process of the preferred embodiment of this invention. More particularly, suitable feeds may comprise petroleum distillate fractions, deasphalted residuum, asphalt containing light atmospheric and vacuum residua, and, in some cases, whole crudes. When the feeds consist of petroleum distillate fractions, said fractions will have a boiling range within the broad range of from about 500° F. to about 1200° F. These fractions include those lube oil fractions boiling within the range of about 600° F. and 1050° F. (at atmospheric pressure) containing between about 5 and about 70% (by weight) of polar and aromatic compounds such as substituted benzenes, naphthalenes, anthracenes and phenanthracenes, characterized by having a carbon content of $C_{15}$–$C_{50}$. Nonlimiting examples of distillate and deasphalted resid feed stocks useful in the instant process include crude oil vacuum distillates from paraffinic and/or naphthenic crudes, deasphalted residual oils, those fractions of catalytic cracked cycle oils, coker distillates and/or thermally cracked oils boiling above about 600° F. and the like. These fractions may be derived from petroleum crude oils, shale oils, tar sand oils, and the like and may come from any source such as the paraffinic crudes obtained from Armaco, Kuwait, the Pan Handle, North Louisiana, Tia Juana, Western Canada, etc., naphthenic crudes such as U.S. Coastal, Venezuelan and Canadian Cold Lake crudes, as well as synthetic feed stocks derived from Athabasca Tar Sands, etc.

The composition of the extraction solvent will comprise, as indicated above, NMP, which may also contain minor amounts of water and may have admixed therewith substantial quantities of other solvents such as alcohols, ketones, light hydrocarbons such as propylene and propane, and the like.

In general, the various means customarily utilized in extraction processes to increase the contact area between the oily feed and the NMP solvent can be employed in extraction zone 40. Thus, the apparatus used in the instant process can comprise a single extraction zone or a multiple extraction zone equipped with trays or other stationary devices to encourage contacting, orifice mixers or other efficient stirring devices such as mechanical agitators, jets of restricted internal diameter, turbo mixers and the like. The operation may be conducted as a batch-type or as a continuoustype operation, with the latter operation being most preferred. A particularly preferred operational embodiment comprises continuous countercurrent extraction. It is important to note that the equipment employed in the operation of the extraction process is not critical to the efficiency and operation of the improvement of the instant invention and may comprise rotating disc contactors, centrifugal contactors, countercurrent packed bed extraction columns, countercurrent tray contactors and the like. In a particularly preferred embodiment of the invention, the extraction zone 40 will comprise a vertical tower with the oily feed being charged to the lower part of the tower and extraction solvent comprising NMP in combination with phenol, and/or water, etc. being charged at the top of the tower. Continuous countercurrent liquid-liquid extraction will prevail within the tower to extract the desired amount of aromatic and/or asphaltic constituents from the hydrocarbon feed stock. In another embodiment of the invention wherein the oily feed is an asphaltic containing resid or whole crude oil, simultaneous deasphalting-solvent refining will be effected within the tower by employing an extraction solvent comprising NMP.

The contacting is carried out at a temperature above about 100° F., but below the temperature of complete miscibility of the feed and the solvent. Normally, an extraction temperature of from 100° to 300° F. and preferably from 120° to 250° F. is employed with both non-asphalt containing feeds and asphalt containing feeds. Solvent dosage within the range of from about 50 to 500 LV% may be used, with a range between 75 and 400 LV% being preferred for combination deasphalting-aromatics extraction and from 75 to 250 LV% used for solvent extracting aromatics and other undesirable polar and aromatic constituents from distillate and deasphalted resid feeds.

As a result of the contact between solvent and feed in extraction zone 40, at least two phases are formed comprising raffinate and extract phases. The raffinate phase contains the desirable lube oil component of the feed and is removed from zone 40 via line 14, while the extract phase containing substantially most of the solvent, polars, aromatics and, in the case of asphaltic resids, asphalt, is removed via line 18.

The raffinate phase containing some NMP therein is fed via lines 14 and 22 through furnace 42 and then via line 26 to flash evaporation-distillation zone 46. Prior to the NMP-containing raffinate entering furnace 42, water is injected into same via line 16 in order to prevent thermal decomposition of the NMP in the raffinate as it passes through the furnace. As hereinbefore described, the exact amount of water to be added will depend upon the amount of NMP present, the temperature to which the raffinate is heated and the amount of time that the raffinate remains at temperatures higher than 500° F. Generally, where the oily feed comprises lube oil distillates, the amount of water to be added will be at least 0.5%, preferably from between 0.5 to 10 LV% and most preferably 1 to 5 LV% based on the NMP content of the raffinate when the raffinate is heated in furnace 42 to temperatures exceeding 500° F. and particularly when exceeding 600° F. Important in understanding the essence of this invention is the fact that even if the extraction solvent comprising NMP contains a substantial amount (i.e.,>2 LV%) of water based on the NMP content thereof, the NMP contained in the raffinate phase may contain more than 0.5, but generally less than about 1 LV% water, thereby necessitating the addition of water thereto prior to its being heated to the high temperatures in the furnace or heater, particularly if the exit temperature of the raffinate is 700° F. or more.

Furnace 42 may be any form of heat exchanger, but in the process of the preferred embodiment of this invention it is a direct fired tube furnace. Generally, the maximum temperature reached by that portion of the raffinate that forms a thin boundary layer on the inside tube surfaces is approximately from about 700° to 800° F., but may range from 600° to 900° F. The temperature of the raffinate (containing the water) exiting from furnace 42 via line 26 generally ranges from 500° to 800° F. and preferably from 600° to 700° F. before being passed into flash evaporation and/or distillation zone 46. In zone 46 the raffinate is first flash evaporated in a flash evaporation section and then distilled in a distillation section, with the solvent and water being removed as overheads via line 30 and the desirable oil exiting at the bottom via line 32.

Essentially the same process occurs with the extract removed from extraction zone or treater tower 40 via line 18. That is, the extract phase is fed via lines 18 and 24 to heater 44 and from thence via line 28 to flash evaporation and/or distillation zone 48. In the case where the extraction solvent comprising NMP contains less than 0.5 LV% water, additional water must be added to the extract before it is heated to temperatures in excess of 500° F. in heating zone 44. The water is added thereto via line 20, the exact amount depending on the time and temperature of the NMP in the heating zone. As hereinbefore described, supra, the exact amount of water required in the extract phase will depend upon the feed, solvent and conditions employed with heater 44. In flash evaporation/distillation zone 48, the solvent comprising NMP and water are removed therefrom as overheads via line 34 and the oily extract via line 36.

The NMP comprising solvent from the evaporation/distillation zones may then be further processed and either recycled back to the extraction zone or sent to solvent storage. Similarly, the raffinate and extract oils may be further processed in order to obtain more useful products therefrom. The water added to the extraction phase via lines 16 and/or 20 may be either relatively solvent free water or may be a portion of water containing extraction solvent from another part of the solvent recovery process such as the extract distillation zone overheads or overheads from steam stripping towers (not shown), if steam stripping is employed to remove the final traces of solvent from the raffinate and extract oils.

The effectiveness of employing water to reduce and minimize thermal decomposition of NMP is illustrated by the following examples.

EXAMPLE 1

In each experiment of this example, NMP was heated in a stainless steel autoclave under nitrogen pressure to temperatures of from 700°to 800° F. for from 3 to 24 hours, with the NMP containing from 0.1 to 2.0 LV% water. At the end of each experiment the autoclave was cooled, opened and the contents filtered. The NMP content of the filtrate was determined by gas chromatographic analysis and the amount of NMP that decomposed was calculated by difference. The decomposition reaction constant K was then calculated for an assumed (approximate) first order reaction according to the following equation:

$$K = -\frac{1}{t}\ln\left(\frac{A}{A_o}\right)$$

where t=reaction time

A=final purity

Ao=initial purity

The results of the experiment are shown in Table 1. It can be seen that as little as 0.3 LV% water reduced thermal decomposition of the NMP.

TABLE 1

EFFECT OF WATER ON NMP STABILITY (PURE SOLVENT)

| Run No. | 1 | 2 | 3 | 4 | 5 | 6 |
|---|---|---|---|---|---|---|
| Water Content, LV % | 0.1 | 0.3 | 1.8 | 0.1 | 2.0 | 0.5 |
| Temperature, °F. | 700 | 700 | 700 | 800 | 800 | 800 |
| Time, hours | 22 | 22 | 24 | 5 | 5 | 3 |
| % NMP(1) | 32.2 | 89.6 | 94.5 | 72.0 | 93.5 | 95.9 |
| $K \times 10^{-7}$ ($sec^{-1}$)(2) | 130 | | 5.2 | 176 | 31 | 28 |
| % NMP Decomposed(1) | 65.6 | | 4.3 | 26.8 | 5.3 | 2.9 |

(1)By GC analysis. Amount of NMP remaining at end of experiment.
(2)First order rate constant for NMP decomposition.

EXAMPLE 2

This experiment was similar to that in Example 1 above, except that the NMP was mixed with an unrefined paraffinic lube oil distillate, a lube oil extract and a lube oil raffinate prior to heating to high temperatures in the autoclave. Addition of 2 LV% water to the mixture typically reduced the extent of NMP decomposition by factors of from about 2 to 4.

What is claimed is:

1. A method for minimizing the thermal decomposition of N-methyl-2-pyrrolidone solvent heated to temperatures above 600° F., which comprises adding water to said solvent so that the water content thereof is at least about 0.5 LV% when said solvent is heated to said temperatures.

2. The method of claim 1 wherein the NMP solvent is mixed with a hydrocarbon and wherein the 0.5 LV% water is based on the NMP content thereof.

3. The method of claim 1 wherein said temperatures range from about 600°to about 900° F.

4. The method of claim 3 wherein the water content of the NMP ranges from about 0.5 to about 10 LV%.

5. The method of claim 4 wherein the water content of the NMP is at least about 1 LV% and wherein said temperatures exceed 700° F.

6. In a hydrocarbon extraction process wherein a hydrocarbon feed is contacted with an extraction solvent comprising NMP to form a raffinate and extract phase with both phases containing NMP and wherein said NMP is recovered from at least one of said phases by employing thermal recovery means and wherein at least one of said NMP containing phases is heated to temperatures above 600° F., the improvement comprising adding water to said phase to that it contains at least 0.5 LV% water based on the NMP content thereof before said phase is heated to temperatures above 600° F.

7. The process of claim 6 wherein said high temperatures range from about 600°to about 900° F.

8. The process of claim 7 wherein said water comprises from about 0.5 to 10 LV% of the NMP.

9. The process of claim 6 wherein said water comprises at least about 1 LV% of the NMP and said temperature exceeds 700° F.

10. In a lube oil extraction process wherein a lube oil feed stock is extracted with a solvent comprising NMP and minor amounts of water to form a raffinate phase containing a desired lube oil and an extract phase containing aromatic and other undesirable lube oil components and wherein a substantial amount of the extraction solvent is recovered by thermal means and wherein at least a portion of at least one of said phase is heated to temperatures above 600° F. in the recovery process, the improvement comprising adding water to said phase so that the water content thereof is at least 0.5 LV% of the NMP content thereof when said phase is heated to said temperatures above 600° F.

11. The process of claim 10 wherein the water content of said phase ranges from about 0.5 to about 10 LV% based on the NMP content thereof while said phase is exposed to said high temperatures.

12. The process of claim 11 wherein said high temperatures range from about 600°to about 900° F.

13. The process of claim 11 wherein the water content of said phase is at least 1 LV% of the NMP content thereof when said phase is heated to said temperatures and wherein said high temperatures exceed 700° F.

* * * * *